US005996312A

United States Patent [19]

Yang

[11] Patent Number: 5,996,312

[45] Date of Patent: Dec. 7, 1999

[54] TENSION ADJUSTING DEVICE FOR A PACKING MACHINE USING PLASTIC FILM

[75] Inventor: Terry Yang, Taipei, Taiwan

[73] Assignee: Tai E International Patent and Law Office, Taipei, Taiwan

[21] Appl. No.: 09/094,971

[22] Filed: Jun. 15, 1998

[51] Int. Cl.[6] ..... B65B 41/12

[52] U.S. Cl. ..... 53/389.2; 53/389.4; 53/389.5; 242/418

[58] Field of Search ..... 242/416, 418; 53/389.1, 389.2, 389.3, 389.4, 389.5

[56] References Cited

U.S. PATENT DOCUMENTS

| | | | |
|---|---|---|---|
| 3,718,354 | 2/1973 | Lemmen | 242/416 |
| 3,809,334 | 5/1974 | Beurer et al. | 242/418 |
| 3,901,002 | 8/1975 | Vetter | 53/389.3 |
| 4,431,142 | 2/1984 | Kataoka | 242/418 |
| 4,604,855 | 8/1986 | Krone et al. | 53/389.3 |
| 4,691,503 | 9/1987 | Frerich | 53/389.3 |
| 5,611,194 | 3/1997 | Wildmoser | 53/389.4 |

*Primary Examiner*—Eugene L. Kim
*Attorney, Agent, or Firm*—Gardere & Wynne, LLP; Sanford E. Warren, Jr.

[57] ABSTRACT

A tension adjusting device for a packing machine using plastic film includes a shaft with a plastic film roll mounted thereto which is pressed by a press member. An axle extends centrally from the press member and is connected to a plate which extends radially and outwardly from a first rotatable rod. The shaft has an end member with which a belt is engaged which has a first end fixedly connected to a first fixed position. A first gear is fixedly connected to the first rotatable rod and a second rotatable rod is located in parallel with the first rotatable rod with a second gear connected to the second rotatable rod and engaged with the first gear. A third gear is connected to the second rotatable rod and has a chain engaged therewith which has one end thereof fixedly connected to a second fixed position and the other end thereof connected to a second end of the belt via a spring so that when the third gear is rotated, the belt is loosened or tightened.

2 Claims, 4 Drawing Sheets

TENSION ADJUSTING DEVICE FOR A PACKING MACHINE USING PLASTIC FILM

FIELD OF THE INVENTION

The present invention relates to a tension adjusting device, and more particularly to an improved tension adjusting device for a packing machine using plastic film to wrap products.

BACKGROUND OF THE INVENTION

One type of packing machines uses plastic film to wrap products so as to prevent the products from being contaminated, the plastic film originally provided in the machine is in the form of a roll of plastic film which is unwrapped by motors and rollers. An outer diameter of the plastic film roll will be gradually reduced because the plastic film is unwrapped from the plastic film roll continuously so that a tension force of the plastic film unwrapped from the plastic film roll varies as the outer diameter of the plastic film roll reduces, and this results in fluctuant wrapping results. In order to resolve the problem, an additional tension adjusting mechanism is added to the packing machine so as to control the tension force on the unwrapped plastic film. By operating the tension adjusting mechanism, the tension force on the plastic film can be maintained at a constant value. However, the additional tension adjusting mechanism occupies a large space so that the packing machine has a larger volume and becomes a complicated structure which is expensive. Furthermore, the complicated structure means higher maintenance costs are required.

The present invention provides a tension adjusting device for a packing machine using plastic film and is able to automatically adjust the tension force on the plastic film during the packing process so that the disadvantages of the conventional tension adjusting mechanism of the packing machine can be mitigated and/or obviated.

SUMMARY OF THE INVENTION

In accordance with one aspect of the present invention, a tension adjusting device for a packing machine is provided which has a shaft on which a plastic film roll is mounted, the tension adjusting device comprising an end member co-rotatably connected to the shaft and having a belt mounted thereto which has a first end thereof fixedly connected to a first fixed position. A press member contacts the plastic film roll and an axle has a first end thereof extending centrally from the press member and a second end thereof connected to a plate which extends radially and outwardly from a first rotatable rod. The first rotatable rod has one of two ends thereof fixedly connected to a first gear.

A second rotatable rod is located in parallel with the first rotatable rod and has a first end thereof fixedly connected to a second gear which is engaged with the first gear, and a second end thereof fixedly connected to a third gear, a chain engaged with the third gear and has a first end thereof fixedly connected to a second fixed position and a second end thereof connected to a second end of the belt by a spring.

It is an object of the present invention to provide a tension adjusting device for a packing machine using plastic film, wherein the speed of the plastic film to be unwrapped can be adjusted automatically.

Further objects, advantages, and features of the present invention will become apparent from the following detailed description with appropriate reference to the accompanying drawings.

DETAILED DESCRIPTION OF THE PREFERRED EMBODIMENT

Figure 1:
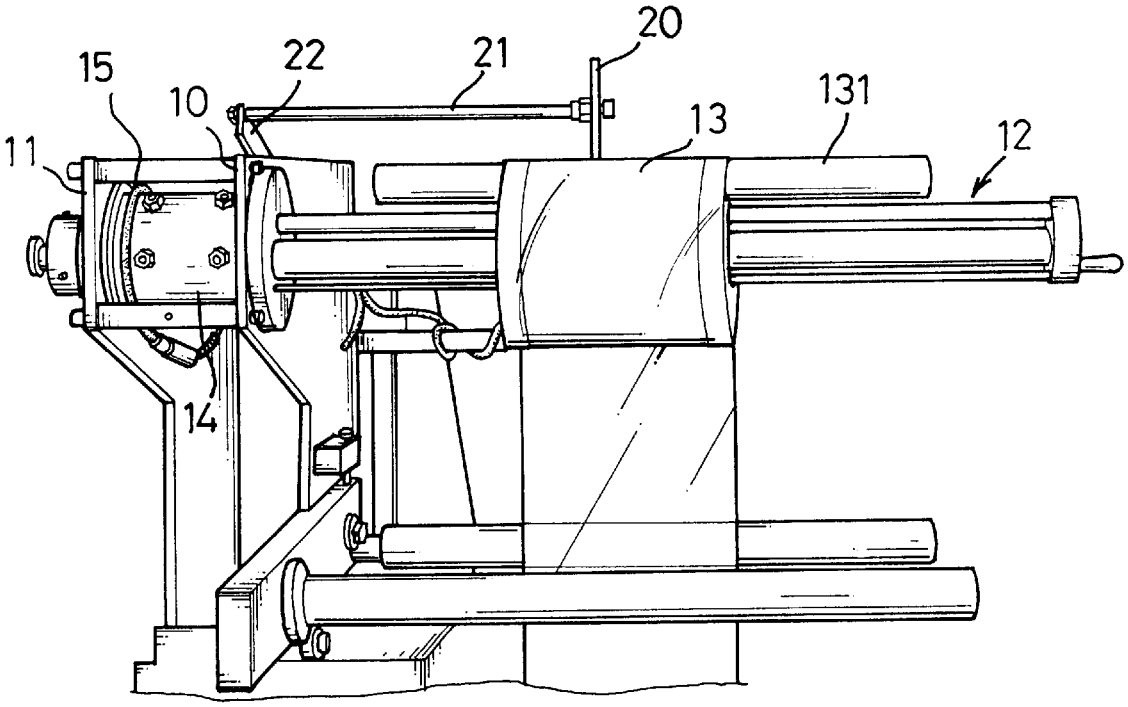
FIG. 1 is a perspective view of a part of a packing machine wherein a tension adjusting device in accordance with the present invention is connected thereto.
Figure 2:
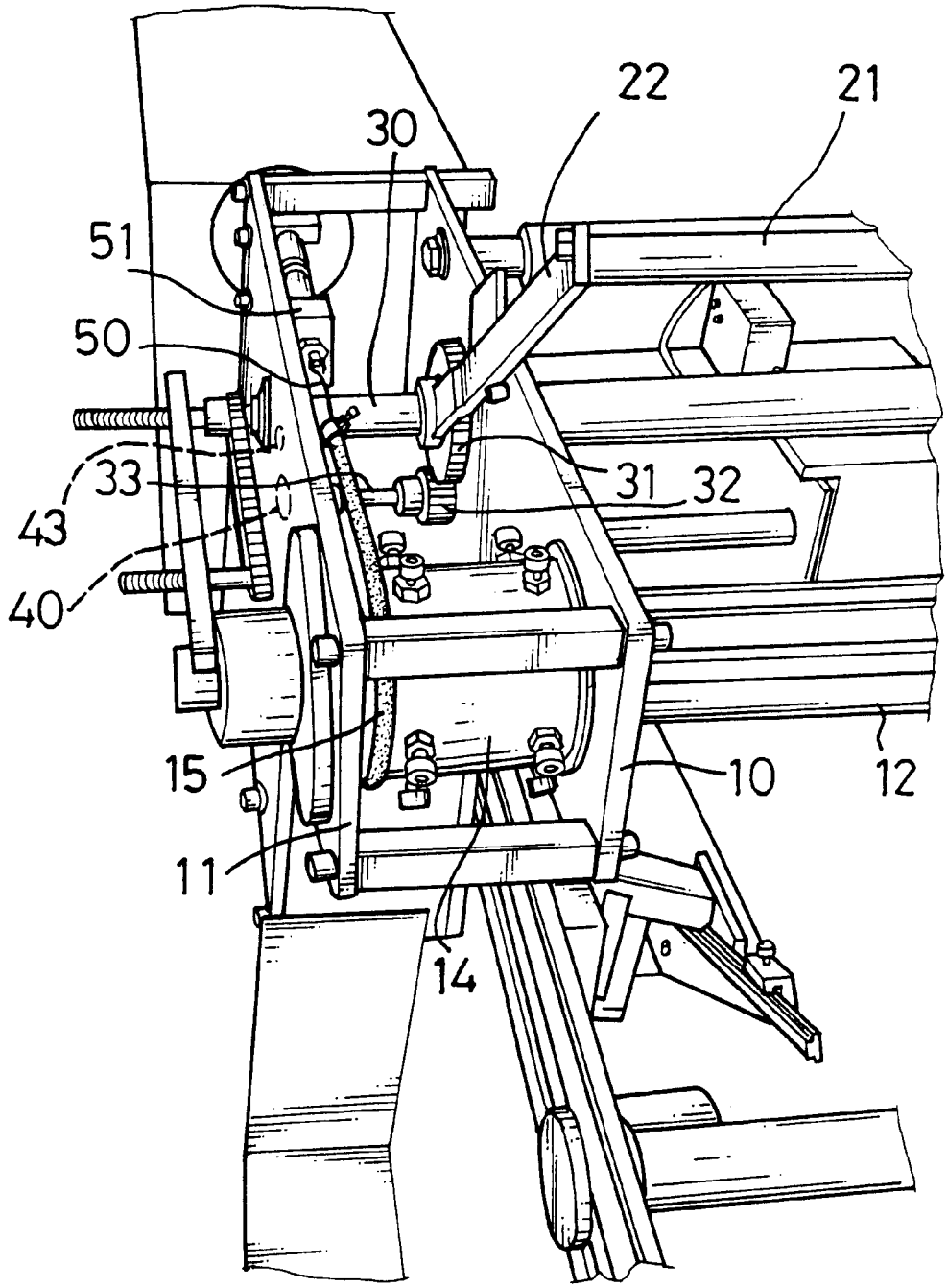
FIG. 2 is a perspective view of the part of the packing machine to show an arrangement of the tension adjusting device of the present invention.

Referring to FIGS. 1 through 4, a packing machine has a shaft set 12 and a casing including a first side wall 10 and a second side wall 11, the shaft set 12 including at least three shafts and having a plastic film roll 13 mounted thereto. The plastic film roll 13 is unwrapped by at least one roller 131. A tension adjusting device in accordance with the present invention comprises an end member 14 connected between the first and the second side wall 10, 11 and being co-rotatably connected to the shaft 12, a belt 15 mounted to the end member 14 so that the tension force of the plastic film unwrapped from the plastic film roll 13 can be adjusted by adjusting the friction between the belt 15 and the end member 14. The belt 15 has a first end thereof fixedly connected to a metal wire 50 which is connected to a first fixed position 51, and a second end thereof connected to a spring 42 which will be described later. A first rotatable rod 30 and a second rotatable rod 33 are connected between the first side wall 10 and the second side wall 11. The first rotatable rod 30 has one of two ends thereof fixedly connected to a first gear 31. A plate 22 has a first end thereof extending radially and outwardly from the second rotatable rod 33 which is located in parallel with the first rotatable rod 30, and a second end thereof connected to a center of a press member 20 which contacts the plastic film roll 13.

The second rotatable rod 33 has a first end thereof fixedly connected to a second gear 32 which is engaged with the first gear 31, and a second end thereof fixedly connected to a sprocket 40 with which a chain 41 is engaged. The chain 41 has a first end thereof fixedly connected to a second fixed position 43 and a second end thereof connected to one of two ends of the spring 42, the other end of the spring 42 is connected to the second end of the belt 15.

Figure 3:
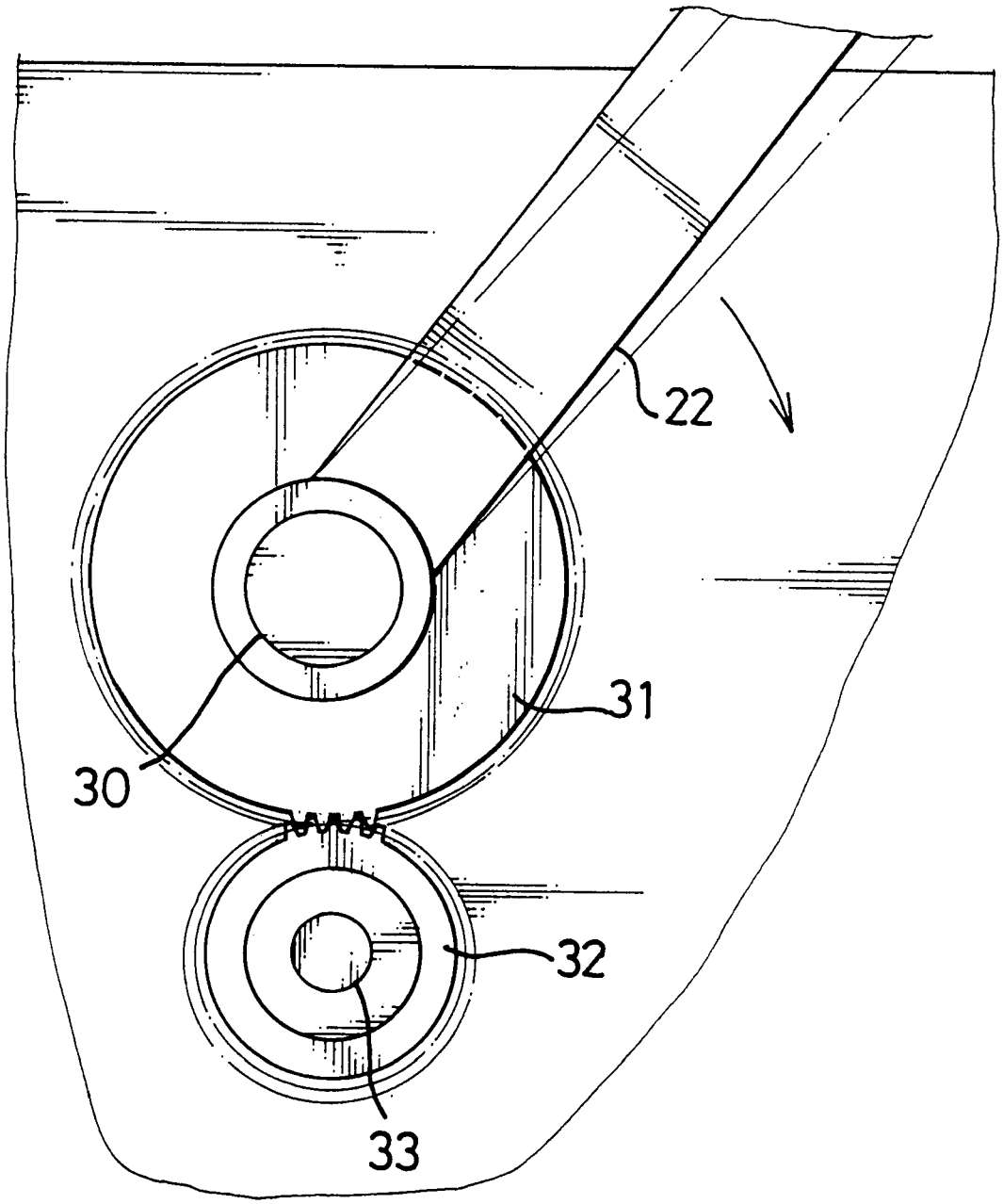
FIG. 3 is an illustrative view to show a first gear and a second gear engaged with each other.
Figure 4:
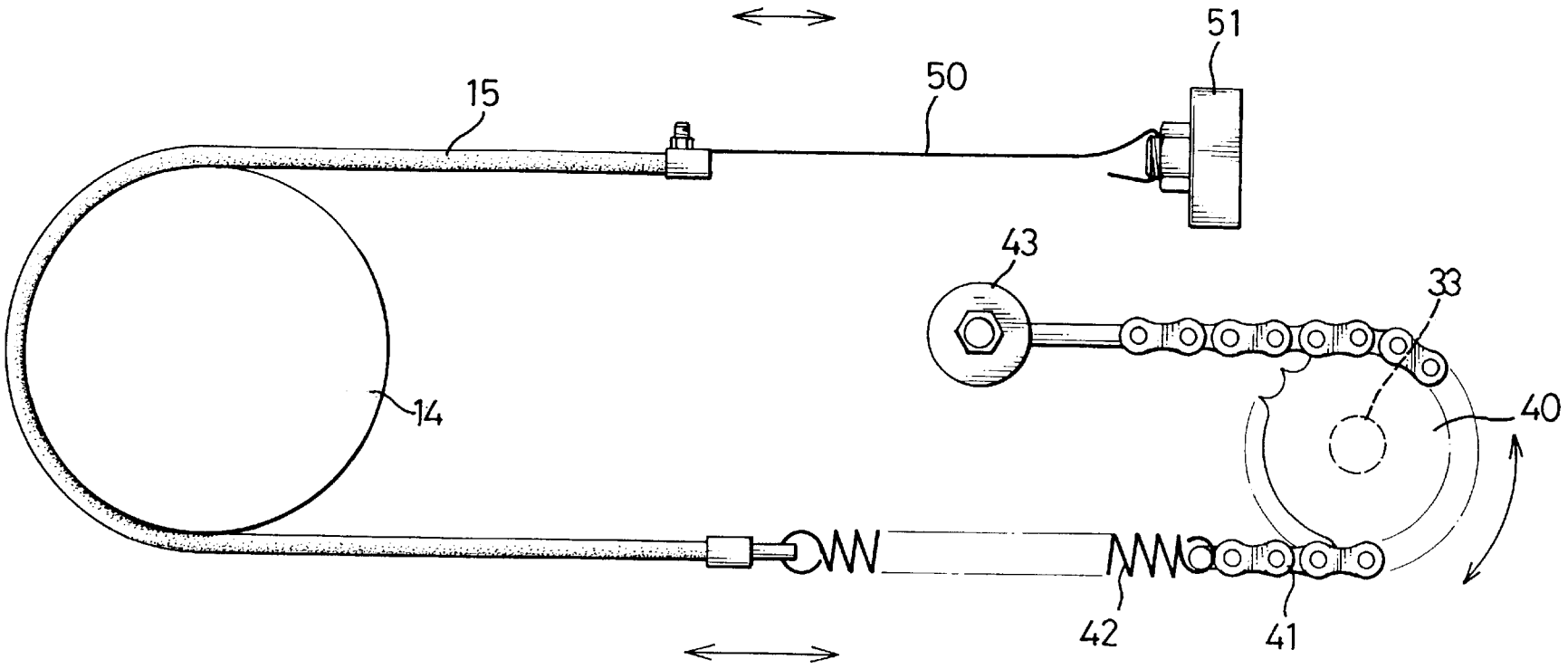
FIG. 4 is an illustrative view to show a belt and related parts connected to the belt.

When the outer diameter of the plastic film roll 13 is reduced, the press member 20 is lowered to stay in contact with the plastic film roll 13. The plate 22 together with the axle 21 connected to the press member 20 is therefore pivoted on an angle so that the first gear 31 is rotated clockwise as shown in FIG. 3, and the second gear 32 together with the third gear 40 are rotated counter clockwise. Further referring to FIG. 4, the third gear 40 pulls the spring 42 to make the belt 15 exert a force on the end member 14 so that the unwrapping speed of the plastic film roll 13 is reduced. The force pulling the plastic film is not changed so that a tension force of the plastic film unwrapped from the plastic film roll 13 can be kept constant.

The tension adjusting device of the present invention has a simple structure and occupies only a small space. The tension force on the plastic film unwrapped from the plastic film roll 13 can be determined by choosing a proper spring 42.

Although the invention has been explained in relation to its preferred embodiment, it is to be understood that many other possible modifications and variations can be made without departing from the spirit and scope of the invention as hereinafter claimed.

What is claimed is:

1. A tension adjusting device for a packing machine which has a shaft to which a plastic film roll is mounted which is unwrapped by at least one roller, said tension adjusting device comprising:

an end member adapted to be co-rotatably connected to said shaft and having a belt mounted to said end member, said belt having a first end thereof fixedly connected to a first fixed position;

a first rotatable rod having one of two ends thereof fixedly connected to a first gear and a plate extending radially from said first rotatable rod, an axle having a first end thereof connected to said plate and a second end thereof connected to a center of a press member which is adapted to contact said plastic film roll; and a second rotatable rod located in parallel with said first rotatable rod and having a first end thereof fixedly connected to a second gear which is engaged with said first gear, and a second end thereof fixedly connected to a sprocket with which a chain is engaged, said chain having a first end thereof fixedly connected to a second fixed position and a second end thereof connected to a second end of said belt by a spring.

2. The tension adjusting device as claimed in claim 1 further comprising a metal wire connected between said first fixed position and said first end of said belt.

* * * * *

UNITED STATES PATENT AND TRADEMARK OFFICE

CERTIFICATE OF CORRECTION

PATENT NO. : 5,996,312
DATED : December 7, 1999
INVENTOR(S) : Terry Yang

It is certified that error appears in the above-identified patent and that said Letters Patent is hereby corrected as shown below:

The assignee is shown as Tai-E International Patent and Law Office, Taipei, Taiwan This error occurred when the above information was typed into the "assignee" section on the Part-B Issue Fee Transmittal Form.

No assignment was filed in this case. The inventor(s) retain ownership of the instant patent.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*